US007861447B2

(12) United States Patent
Park

(10) Patent No.: US 7,861,447 B2
(45) Date of Patent: Jan. 4, 2011

(54) OUTDOOR FLUORESCENT LAMP FIXTURE

(76) Inventor: Jae-Kil Park, 316-7, San-gyuk-2-dong, Buk-gu, Daegu (KR)

( * ) Notice: Subject to any disclaimer, the term of this patent is extended or adjusted under 35 U.S.C. 154(b) by 587 days.

(21) Appl. No.: 11/666,245

(22) PCT Filed: Oct. 25, 2005

(86) PCT No.: PCT/KR2005/003559

§ 371 (c)(1),
(2), (4) Date: Mar. 12, 2008

(87) PCT Pub. No.: WO2006/046828

PCT Pub. Date: May 4, 2006

(65) Prior Publication Data

US 2008/0250684 A1 Oct. 16, 2008

(30) Foreign Application Priority Data

Oct. 25, 2004 (KR) ..... 10-2004-0085471

(51) Int. Cl.
*G09F 13/04* (2006.01)
*F21V 21/00* (2006.01)

(52) U.S. Cl. ..... 40/564; 248/276.1; 248/279.1; 362/249.07; 362/220

(58) Field of Classification Search ..... 40/564; 362/220, 225, 217.09, 238, 239, 249.07; 439/215; 248/276.1, 279.1, 287.1, 298.1
See application file for complete search history.

(56) References Cited

U.S. PATENT DOCUMENTS 5,368,495 A * 11/1994 Raby et al. ..... 439/226
7,726,839 B2 * 6/2010 Chien ..... 362/249.03

* cited by examiner

*Primary Examiner*—Cassandra Davis
(74) *Attorney, Agent, or Firm*—Banner & Witcoff, Ltd.

(57) ABSTRACT

Provided is a lamp supporting device mounted in an illuminating advertising signboard, particularly which is formed as an assembly type that makes carrying and storage thereof convenient thereby being generally used without limitation in various sizes (length) of lamps with simple replacement of a center frame, and can arrange lamps in a way being overlapped thereby avoiding blackening and in a plurality of lines while freely adjusting the width between the lamps.

7 Claims, 9 Drawing Sheets

[Fig. 1]
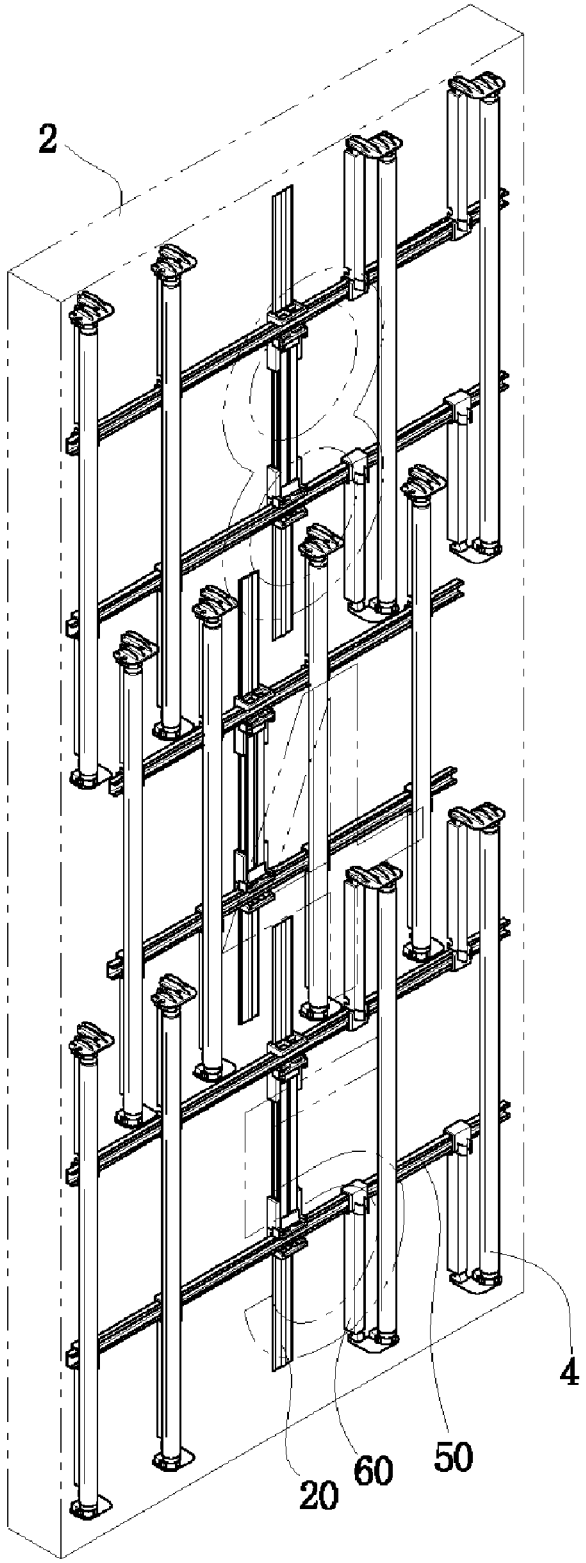

[Fig. 2]
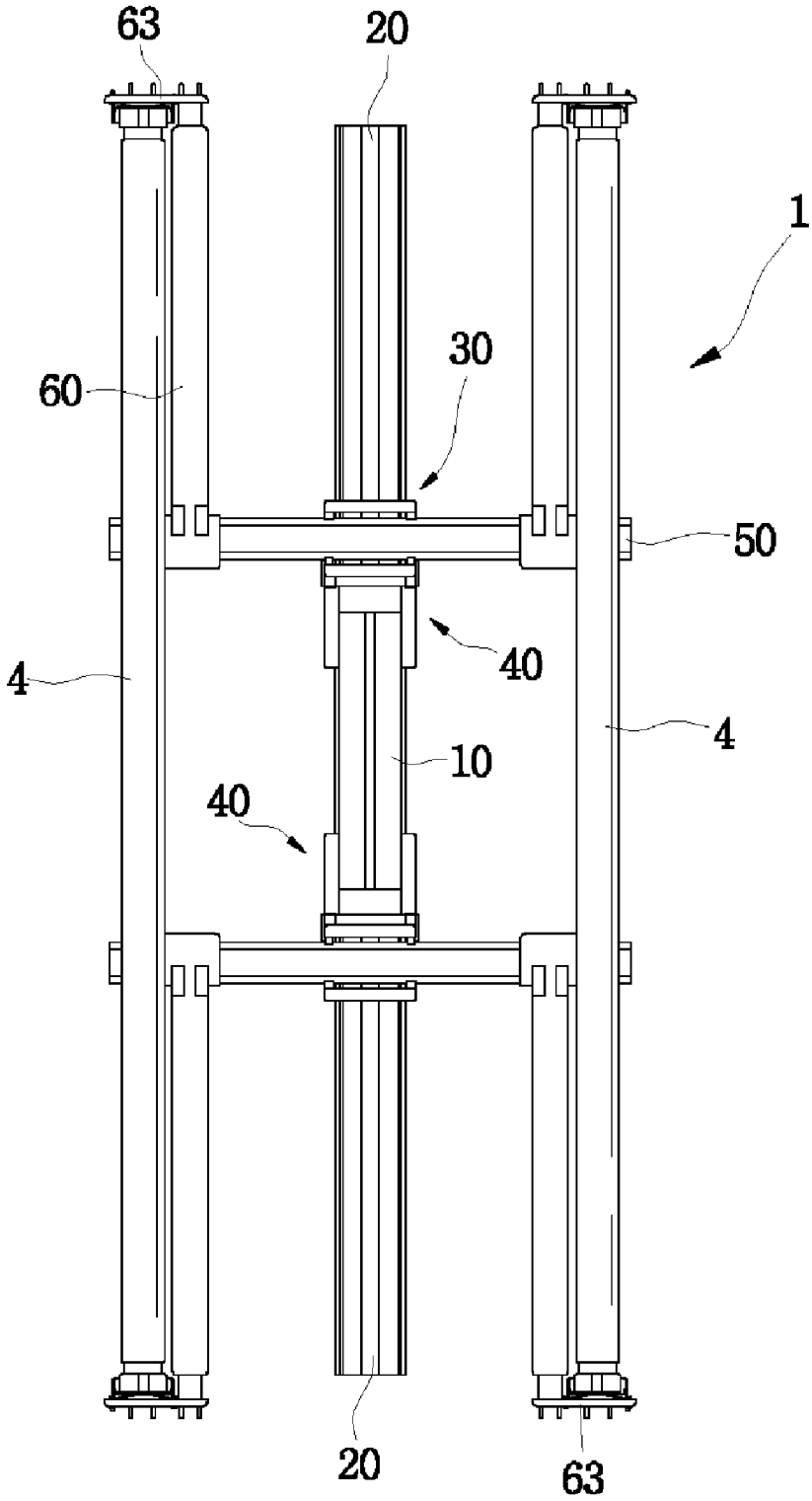

[Fig. 3]
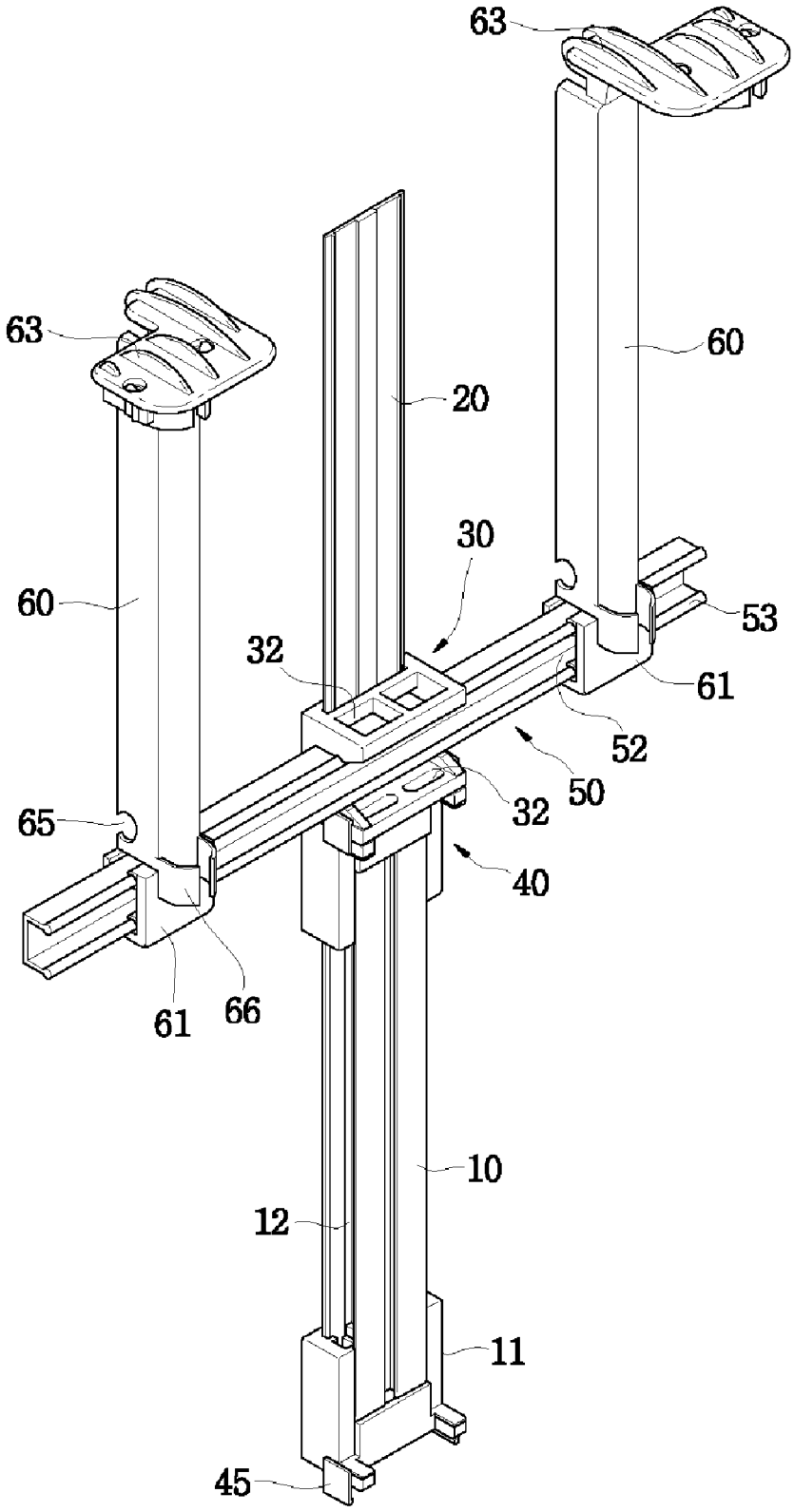

[Fig. 4]
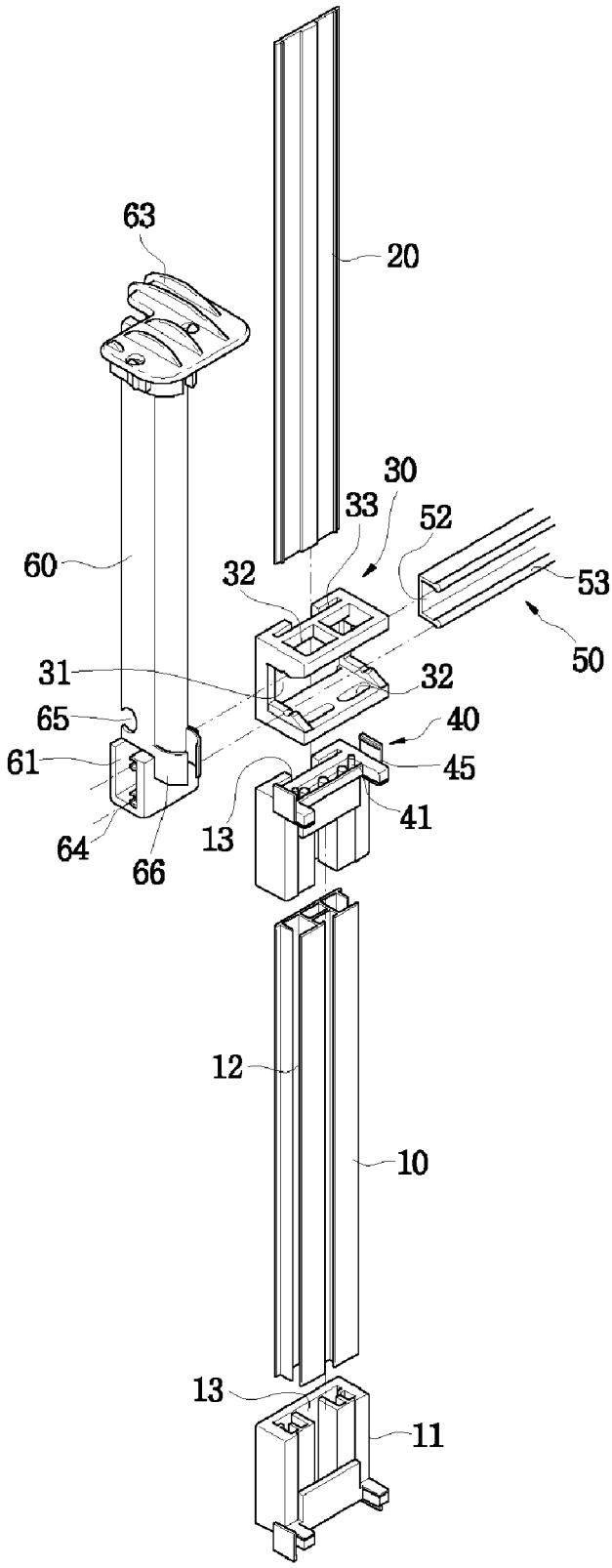

[Fig. 5]
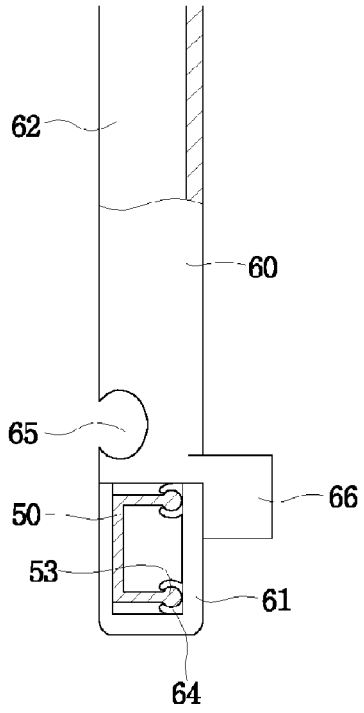
[Fig. 6]
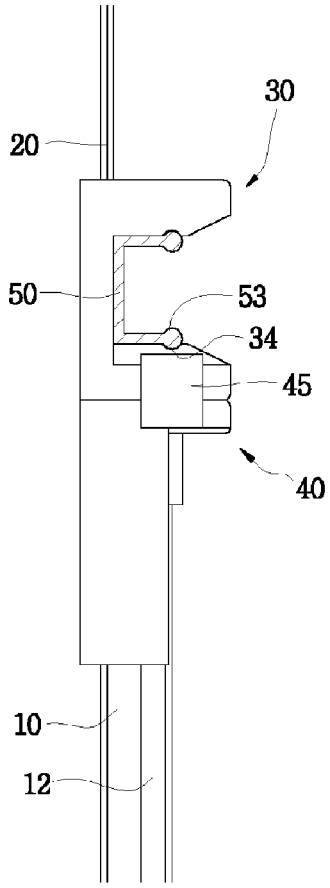

[Fig. 7]
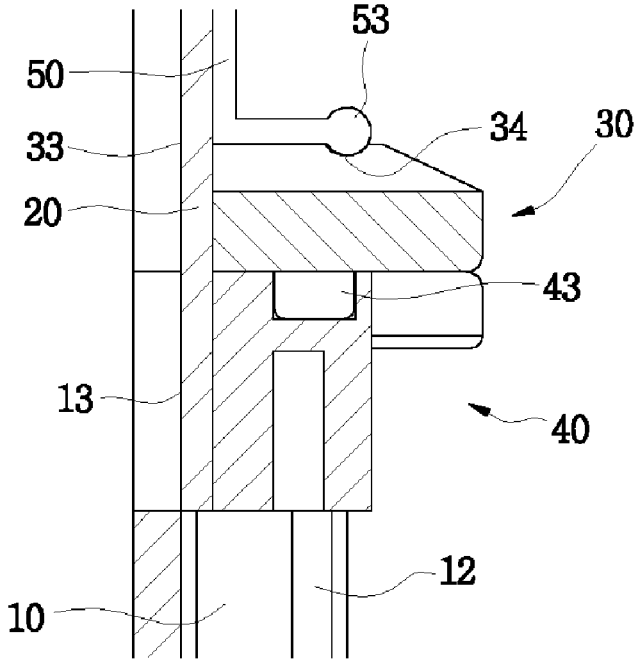
[Fig. 8]
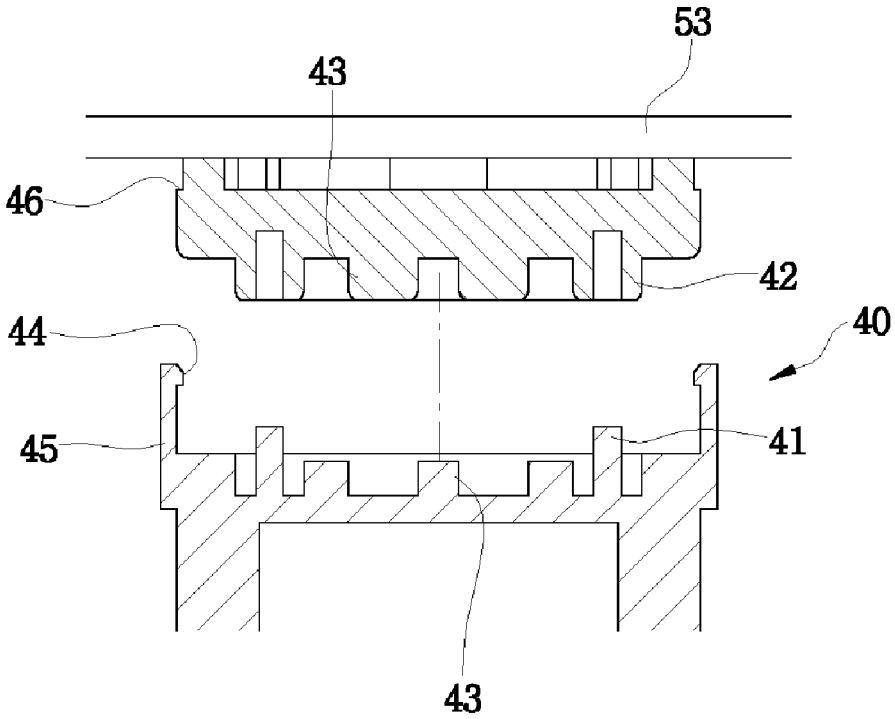

[Fig. 9]
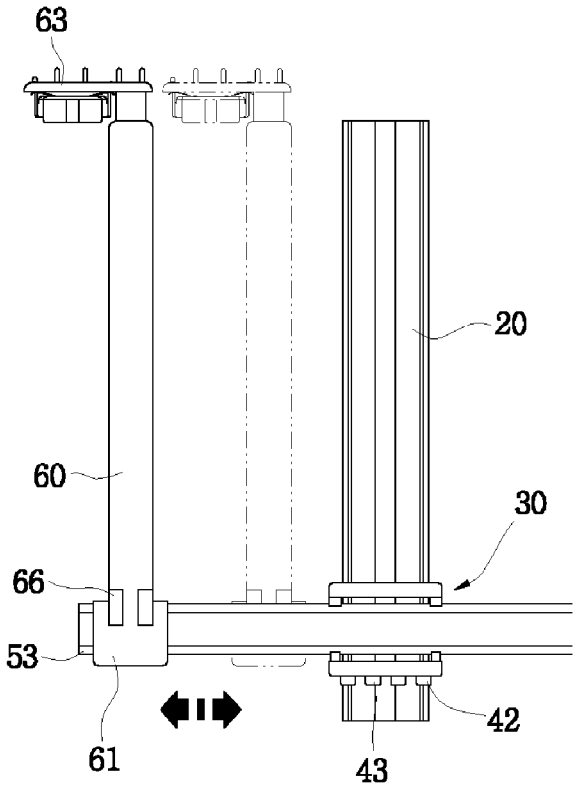
[Fig. 10]
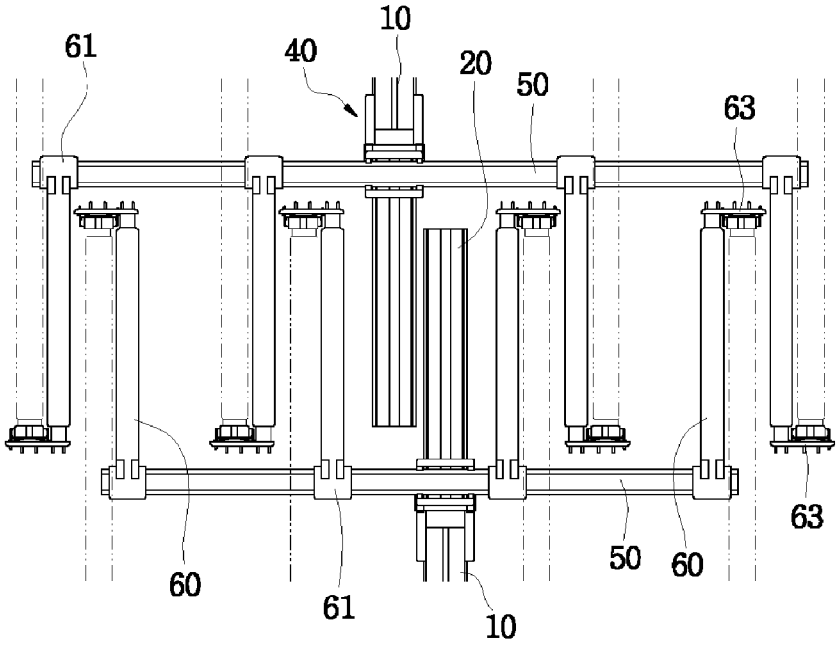

[Fig. 11]
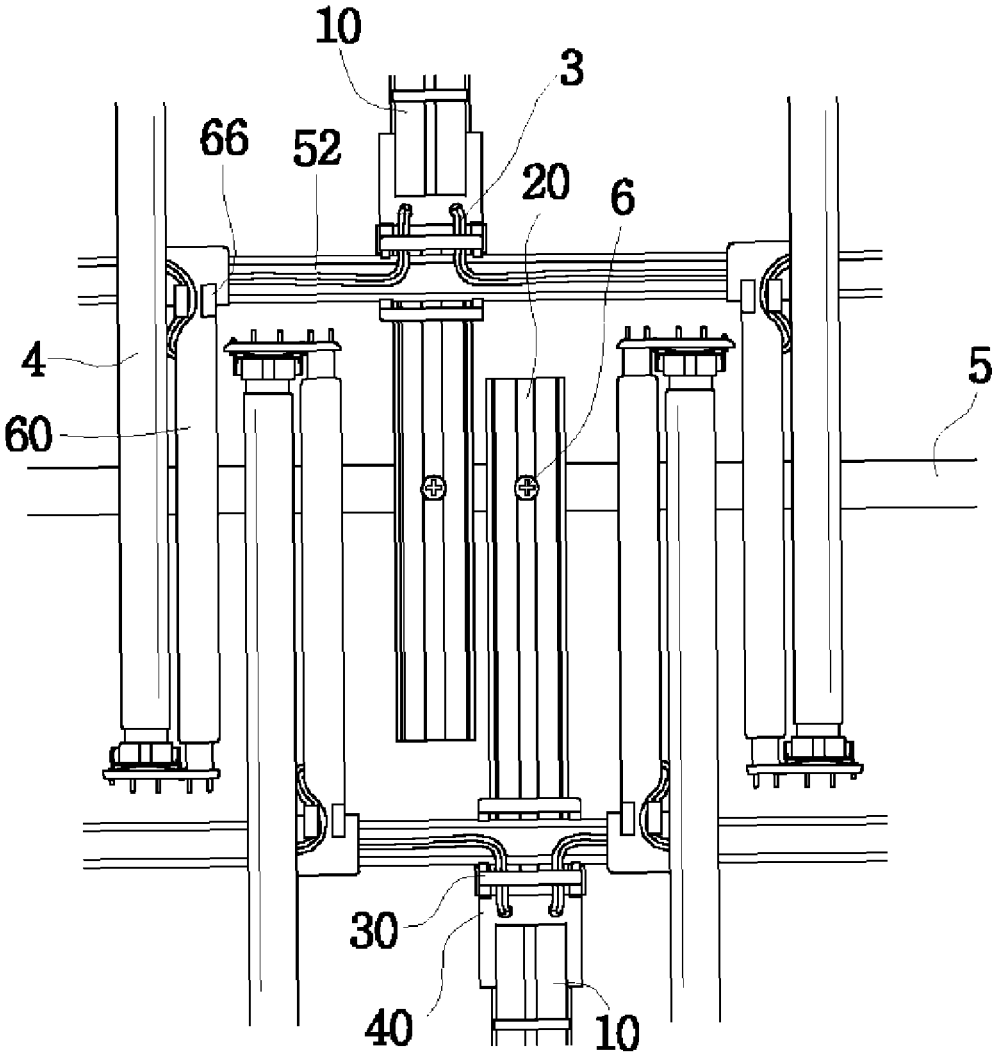

[Fig. 12]
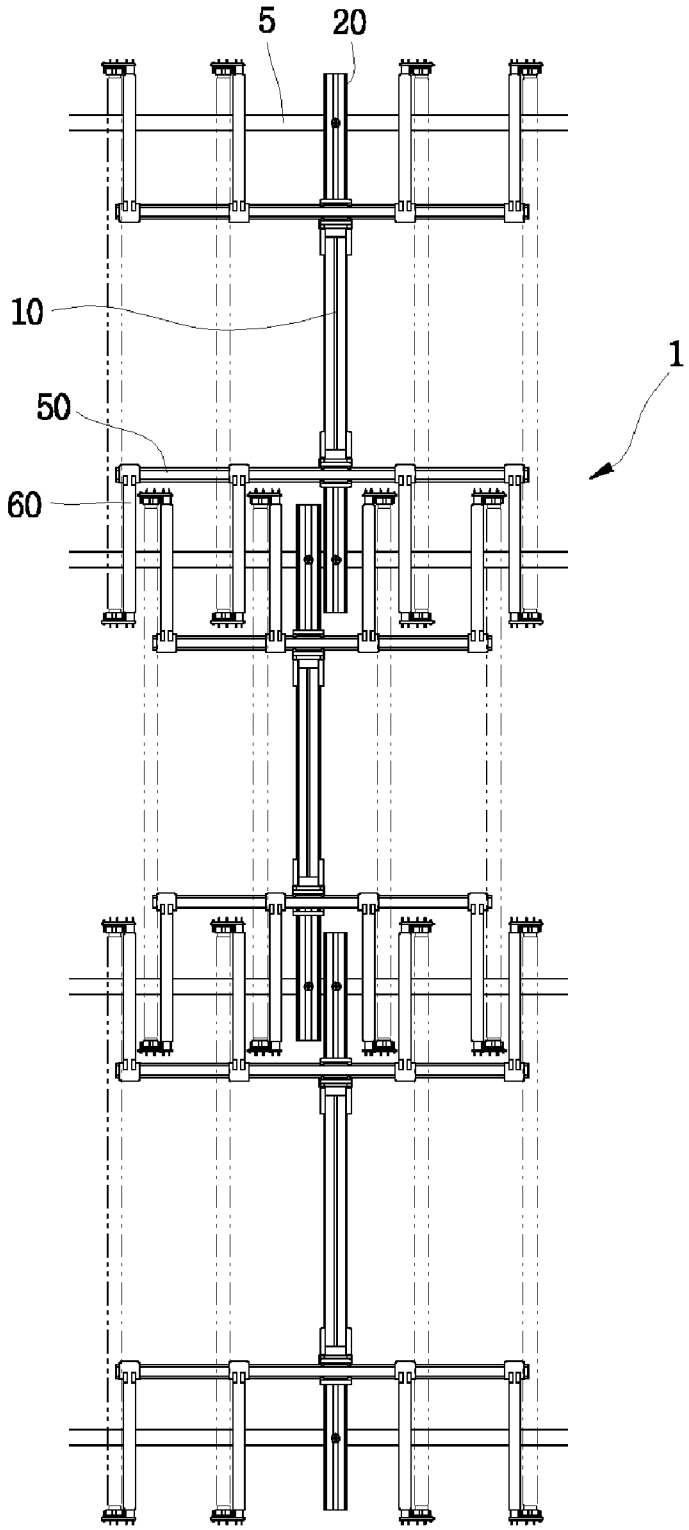

OUTDOOR FLUORESCENT LAMP FIXTURE

This application is a national stage application of co-pending PCT application PCT/KR2005/003559 filed Oct. 25, 2005, which was published in English under PCT Article 21(2) on May 4, 2006, which claims the benefit of Korean Patent application no. 10-2004-0085471 filed Oct. 25, 2004, the disclosure of which is expressly incorporated herein.

TECHNICAL FIELD

The present invention relates to a lamp supporting device equipped in an illuminating advertising signboard, particularly which is formed as an assembly type that makes carrying and storage thereof convenient thereby being generally used without limitation in various sizes (length) of lamps by simply replacing the center frame, and can arrange the lamps in a way being overlapped, thereby avoiding blackening and in a plurality of lines while freely adjusting the width between the lamps.

BACKGROUND ART

Generally, Flex, acryl signboards or the like have been mainly used in signboard manufacturing field. These boards are mostly manufactured in a rectangular form having various sizes, in which a plurality of lamps for illumination are mounted inside, and thus generated light helps the advertised graphic sign, name or the like represented in the front or the side of the advertising board to be distinctively shown at night.

DISCLOSURE OF INVENTION

Technical Problem

The lamps used in the conventional advertising board have been supported and fixed by only electric wires connected to the both electrodes thereof without using a separate supporting tool. Accordingly, in long-term use, these lamps were likely to be loosened from the electrodes owing to its own load or impacts or vibrations from outside such as wind, which causes malfunctioning thereof.

To solve these problems of the conventional ones, there has been a method suggested, in which a distinct supporting tool having receptacles for a fluorescent lamp on each end thereof is mounted inside a signboard so as to stably support the lamp.

However, the lamp supporting tool has a structure of one lamp-one supporting tool wherein only one lamp can be mounted on one supporting tool, therefore when being applied to a signboard where a plurality of lamps are used, the number of the supporting tool should be increased relative to the number of the lamps used, consequently resulting in increase in manufacturing and installing cost.

For solving the aforementioned problem, a registered utility model No. 0120025, a tool for supporting a fluorescent lamp used in an advertising signboard, which was previously filed by the present inventor, has been suggested.

The previously registered utility model provides a tool on which at least two fluorescent lamps can be mounted, thereby significantly reducing the cost for manufacturing and installing supporting device for fluorescent lamp. The tool is useful in a way that it makes possible to easily achieve desired level of illumination and to increase the light efficiency of the fluorescent lamps in a certain shape of a signboard by selecting the distance between the fluorescent lamps to a certain width, and to prevent the fluorescent lamps from being sagged in the lapse of time by supporting the middle part of a long fluorescent lamp with lamp supporting members.

However, despite the above-mentioned advantages, the previously registered utility model has some drawbacks such that the body of the supporting device is rather long even in a disassembled state since the tool has a structure which can be partially assembled, in which the body of the supporting device and supporting members for sockets can be disassembled, resulting in increase in physical distribution and storage cost. Particularly, since the length of the supporting device body is limited, it can not be generally used for fluorescent lamps having various sizes (length).

Further, when disposing the supporting tools continuously in lengthwise direction, it is not possible to dispose the fluorescent lamps continuously in a way being overlapped owing to interference of socket supporting members facing each other, thereby forming space where light is absent between the fluorescent lamps, resulting in blackening that is a phenomenon being dimmed as compared to the surroundings and thus decrease in illumination.

Technical Solution

The present invention is to solve these drawbacks of the previously registered designs, therefore the technical object of the present invention is to provide all of the structural elements of the present invention as each disassembled unit which can be instantly assembled at a desired site as a supporting device, thereby reducing physical distribution and storage cost, and to generally use the tool without being limited by various sizes of lamps by simply replacing a center frame with one suitable for a certain size of a lamp.

Further, another object of the present invention is, when mounting the supporting devices in continuous way, to arrange the lamps in a way being overlapped without being interfered by other lamp supporters, thus being possible to avoid blackening, by combining a lamp supporter by which a lamp is supported to a slide frame in a way that the lamp supporter is protruded outward.

Additionally, still another object of the present invention is to coupling the lamp supporters in a plurality of lines to one supporting device in a way that the width between the lamps is freely adjusted, accordingly a plurality of lamps can be arranged in a plurality of lines.

BRIEF DESCRIPTION OF THE DRAWINGS

FIG. 1 is a perspective view of a lamp supporting device applied to an illuminating advertising signboard according to one embodiment of the present invention.

FIG. 2 is a front view illustrating a lamp supporting device according to the present invention by which a plurality of lamps are supported.

FIG. 3 is a perspective view illustrating an assembled lamp supporting device according to the present invention.

FIG. 4 is a perspective view of a decomposed lamp supporting device according to the present invention.

FIG. 5 is a side cross-sectional view illustrating the binding of a center frame with a fixing frame according to the present invention.

FIG. 6 is a side cross-sectional view illustrating the fixed lamp supporter according to the present invention.

FIG. 7 is a side cross-sectional view illustrating the binding of a first connecting member with a second connecting member according to the present invention.

FIG. 8 is a front cross-sectional view illustrating the binding of the first connecting member with the second connecting member according to the present invention.

FIG. 9 is a schematic view illustrating widthwise movement of a lamp supporter for adjusting the distance between other lamp supporters according to the present invention.

FIG. 10 is a schematic view illustrating the lamp supporters mounted as being partially overlapped according to the present invention.

FIG. 11 is a view illustrating one embodiment of electric wire alignment according to the present invention.

FIG. 12 is a view illustrating the lamp supporters being mounted in several lines according to the present invention.

NUMERALS RELATIVE TO MAIN PARTS IN DRAWINGS

1: supporting device
10: center frame
11: first connecting member
12,52,62: electric wire receiving grooves
20: fixing frame
30: second connecting member
31: joint part
32: guide hole
40: binding means
41: protrusion
42: projected piece
43: intermediate protrusion
45: flexible end protrusion
46: stopper
50: a slide frame
60: lamp supporter
61: joint end part
63: lamp socket

BEST MODE FOR CARRYING OUT THE INVENTION

Now, the present invention is further described in detail through the preferred embodiments according to the present invention, which effectively achieve the technical object of the present invention.

The present invention is characterized with an assembly type structure which improves economy thereof and provides universal application without being limited by the sizes of lamps; particularly a structure in which lamp supporters (60) by which lamps are supported are mounted in a way being partially overlapped by each other so as to avoid blackening that can be occurred by the space between continuously arranged lamps (4); and a structure which can mount lamps in a plurality of lines onto one lamp supporting device (1).

The schematic construction of the lamp supporting device (1) of the present invention, as seen from FIGS. 3 and 4, comprises a center frame (10), wherein a first connecting member (11) is detachably coupled by insertion to the both upper and lower ends of the center frame; a fixing frame (20) which fixes a lamp supporting device (1) firmly to a signboard frame (5) by being coupled to the first connecting member (11) by insertion; a second connecting member (30) which is inserted around the fixing frame (20) and bound to the first connecting member (11) while supporting the slide frame (50); a binding means (40) which binds the first and the second connecting members (11, 30) closely together to form one integral unit; a slide frame (50) which is disposed passing through the second connection member (30); a plurality of lamp supporters (60) which are movably fixed to the slide frame (50) in a way that the width can be optionally adjusted. The lamp supporting devices (1) can be continuously mounted along a vertical line inside the advertising signboard (2) to illuminate the signboard.

Hereinafter, one practical embodiment of the present invention of which schematic construction has been outlined above, is described further in detail.

The center frame (10) which forms the backbone structure of the lamp supporting device (1) is configured as an assembly with a selectively detachable first connecting member (11) being coupled to the upper or lower end thereof by insertion, and has an electric wire receiving hole (12) formed along the lengthwise direction on both sides thereof by which the electric wire connected with a lamp socket (63) can be concealed so as not to be exposed outside, thereby providing neat appearance as well as helping to prevent accidents.

The first connecting member (11) is a medium for interconnecting the center frame (10) and the fixing frame (20), and thus has a coupling part (3) into which the center frame (10) and the fixing frame (20) can be inserted at the same time, on each upper and lower end thereof.

Owing to the structure that the center frame (10) can be assembled with the first connecting member (11), when using other lamp (4) in different size, for example a rather longer lamp, it can be simply applied to the present invention by only disassembling the center frame (10) from the first connecting member (11), and mounting and assembling other ready-manufactured center frame (10) suitable for the size of the lamp (4).

Therefore, through a simple method replacing a center frame (10), it becomes possible to apply the device of the present invention for general use without being limited by the species of lamps (4) having various sizes, thereby providing convenience in work as well as reducing time for work and cost in significant way.

Specifically, since a center frame (10) and a fixing frame (20) which are served as a backbone can be disassembled as each separate unit, the volume of the entire units can be reduced compactly, resulting in decrease in physical distribution and storage cost.

The fixing frame (20) which forms one integral unit with a center frame (10) by being inserted into the coupling part (3) of the first connecting member (11) has a function of fixing the whole lamp supporting device (1) to the inside of an advertising signboard (2) by being coupled to the signboard frame (5) inside the advertising signboard (2) through the fixing hole (6), as illustrated in FIG. 11.

The second connecting member (30) which is inserted around the fixing frame (20) has a coupling part (33) communicating through the upper and lower part thereof so that the fixing frame (20) can be coupled as one integral unit through the coupling part (33). In the coupled state, the second connecting member (30) also conducts a function of supporting the slide frame (50) as well as binding the first connecting member (11).

Particularly, on the front part of the second connecting member (30), a joint part (31) which communicates with each side is formed, through which a slide frame (50) passes while crossing the fixing frame (20) perpendicularly, therefore the slide frame (50) can be maintained as firmly assembled state.

Further, on the front upper and lower part of the joint part (31), a plurality of guide holes (32) for guiding electric wire (3) are formed, wherein the guide hole (32) leads the electric wire (3) which is connected to a lamp socket (63) to the electric wire receiving hole (12) of the center frame (12) via electric wire receiving groove (52) formed on the slide frame (50).

On the while, in the binding means (40) that firmly binds the first and the second connecting member (11) (30) close to each other so as to form one integral unit with the center frame (10) and the fixing frame (20), as illustrated in FIGS. 7 and 8, a protrusion (41) is formed on each side of the upper surface of the first connecting member (11) and projected pieces (42) for coupling to which said protrusions (41) are coupled by insertion are formed on the corresponding second connecting member (30). Moreover, a plurality of intermediate protrusions (43) which are separately formed at a certain interval on the space between the protrusions (41), and the projected pieces (42) for coupling are alternately coupled so as to form one integral unit.

At the same time, on each side of the upper surface of the first connecting member (11), a flexible end protrusion (45) having a hook (44) is formed, and corresponding to this, on both side of the lower part of the second connecting member (30), a stopper (46) by which the hook (44) is caught is formed by relatively recessed parts.

Therefore, in addition to the binding power of the coupling between the protrusion (41) and the projected pieces (42) for coupling, provided is binding between the flexible end protrusion (45) and the stopper (46). Accordingly, the center frame (10) and the fixing frame (20) can be maintained as more firmly assembled state, thus providing rather stable support for a lamp (4). On the while, disassembling can be practiced with ease by releasing the binding means (40).

As for the slide frame (50) which is coupled to the second connecting member (30) by passing through the joint part (31) while crossing the fixing frame (20) perpendicularly, it is in the form of "□" (square with one open end) with an electric wire receiving groove (52) in the center, and on the upper and lower part of the open end, a projected rim (53) is formed along the lengthwise direction. As the projected rim (53) is slid into the round groove (34) of the joint part (31), the slide frame cannot be released from the second connecting member (30) without applying intended manual operation.

In the lamp supporter (60) which is movably fixed to the slide frame (50) so as to freely adjust the distance between lamps, a joint end part (61) which is coupled with a slide frame (50) is formed on one end thereof, wherein the joint end part (61) has a pair of round grooves (64) formed inside of the upper and the lower part thereof so that each projected rim (53) of the slide frame can be slid thereinto. On the other end of the lamp supporter (60), a lamp socket (63) which supports a lamp (4) is formed.

On the rear side of the lamp supporter (60), an electric wire receiving groove (62) is formed to conceal the electric wire (3) from outside. On both sides adjacent to the joint end part (61), a lead-in hole (65) communicating with the electric wire receiving groove (62) is formed, and on the front of the joint end part (61), a pair of holding pieces (66) is formed to hold the electric wire (3) for preventing sagging of the electric wire (3) which passes through the lead-in hole (65), thereby achieving neat alignment of electric wires (3) connected to the lamp socket (63).

Depending on the number of lamps to be mounted on a slide frame (50), a number of lamp supporters (60) can be used as being combined together, thereby it becomes possible to align a number of lamps (4) in a plurality of lines at the same time on one lamp supporting device (1). Each lamp supporter (60) can be moved widthwise along the slide frame (50) so as to adjust the distance from other lamps, thus it becomes possible to readily obtain the level of illumination desired by customers.

Further, since the lamp supporter (60) of the present invention is, unlike conventional ones, coupled to a slide frame (50) in a way of being stuck out outwardly, when mounting the lamp supporting device (1) in continuous way, interference between facing lamp supporters (60) does not occur. Therefore, as seen from FIG. 10, it is possible to align the facing lamp supporters (60) in a way of being partially overlapped to a certain degree, accordingly blackening which is caused by the space between continuously aligned lamps (4), can be avoided, thereby more increasing the effect of illumination.

Further, the general assembling procedure of the present invention which is configured as above, supporting, a lamp (4) in supported state and a lamp supporting device (1) in continuously mounted state are described below.

Firstly, framing assembly of the lamp supporting device (1) is achieved by combining a first connecting member (11) to a center frame (10) which has a suitable length for the size of a lamp (4) being used, and then binding a second connecting member (30) which has been coupled to a fixing frame (20) to the first connecting member (11) to form one integral unit.

After forming the framework (i.e. the combined structure of a center frame and a fixing frame) as described above, a slide frame (50) is coupled to the second connecting member (30) in a way crossing the fixing frame (20) perpendicularly, and a plurality of lamp supporters (60) are coupled thereto at both sides of the fixing frame (20).

At this time, a number of lamp supporters (60) corresponding to the desired number of lamps (4) are arranged in multiple lines at a certain interval.

Therefore, the present invention makes its carrying and storage very convenient since the lamp supporting device (1) can be formed by instant assembly of each structural element provided as separate units at a desired site, and can enhance illumination effect by mounting lamps (4) in multiple lines while freely adjusting the distance between lamps.

When applying the present invention to a large size of an advertising signboard (2), the preset invention can effectively prevent blackening in continuous alignment of lamp supporting devices (1), since interference from facing lamp supporter (60) does not occur and thus a lamp (4) can be aligned in a way being overlapped with other facing lamp (4) as seen from FIGS. 10 to 12.

On the other hand, as for alignment of the electric wire (3) according to the present invention, the electric wire (3) connected to a lamp socket (63) as illustrated in FIG. 11 passes through a lead-in hole (64) via an electric wire receiving hole (62) and is hooked between the holding pieces (66). Then, the electric wire (3) hooked by the holding pieces (66) passes through a guide hole (32) and a hole which is punched during the mounting procedure via the slide frame (50), and is lead to the electric wire receiving hole (12) of the center frame (10). Consequently, the present invention additionally provides an effect of neat and clean maintenance of the electric wire (3).

INDUSTRIAL APPLICABILITY

As apparent from the description above, all of the structural elements of the present invention are provided as each separate unit and can be instantly assembled as a supporting device, thereby being possible to reduce physical distribution and storage cost. Further, by using a simple method of only replacing a center frame with one suitable for a certain size of a lamp, this invention provides an effect of being generally used without being limited by various sizes of lamp.

Moreover, when mounting the supporting devices in continuous way, the present invention makes possible to arrange the lamps in a way being overlapped without being interfered by other lamp supporters facing each other, thereby being possible to avoid blackening and enhance the illumination. It is also possible to arrange the lamps in a plurality of lines at one supporting device, thus improving the workability, while the width between lamps can be freely adjusted so as to enhance the illumination effect.

The invention claimed is:

1. A lamp supporting device for an advertising sign comprising:

a center frame (10), wherein two first connecting members (11) are detachably coupled by insertion to both upper and lower ends of the center frame respectively;

a fixing frame (20) which fixes a lamp supporting device (1) firmly to a signboard frame (5) by being inserted to upper and the lower ends of the first connecting members (11);

a second connecting member (30) which is inserted around the fixing frame (20) and bound to the first connecting member (11) while supporting a slide frame (50);

a binding means (40) which binds the first and the second connecting members (11, 30) closely together to form one integral unit;

the slide frame (50) crosses the fixing frame (20) by passing through the second connection member (30); and a plurality of lamp supporters (60) which are movably fixed to the slide frame (50) so as to adjust the distance between lamps and have sockets (63) at one end thereof.

2. The lamp supporting device for an advertising sign according to claim 1, wherein the center frame (10) can be replaceable with other center frame having appropriate length according to the size (length) of a lamp (4) by detaching from the first connecting member (11) connected to the upper and lower end thereof, wherein the first connecting member (11) has coupling parts (13) at the upper and the lower end, to which the center frame (10) and the fixing frame (20) are coupled by insertion, respectively.

3. The lamp supporting device for an advertising sign according to claim 1, wherein the center frame (10) has electric wire (3) receiving grooves (12) on each side thereof so as to conceal electric wire.

4. The lamp supporting device for an advertising sign according to claim 1, wherein the second connecting member (30) has a joint part (31) through which the slide frame (50) passes while crossing the fixing frame (20), wherein the joint part (31) has round grooves (34) on upper and lower part thereof so that a projected rim (53) of the slide frame (50) is fixed by being slid into the round grooves, and a plurality of guide holes (32) on a front part of the upper and a lower part of the joint part (31), wherein the guide holes guide electric wire (3) to an electric wire receiving groove (12) of the center frame (10) via electric wire receiving groove (52) of the slide frame (50).

5. The lamp supporting device for an advertising sign according to claim 1, wherein the binding means (40) binds the first and the second connecting members (11,30) integrally together by coupling a plurality of protrusions (41) formed on an upper surface of the first connecting member (11) with projected pieces (42) for coupling correspondingly formed on the second connecting member (30) by insertion and alternate coupling of intermediate protrusions (43) which are separately formed at a certain interval on a space between protrusions (41) and the projected pieces (42), respectively, while flexible end protrusions (45) formed on the upper surface of the first connecting member (11) at both ends thereof are caught by a stopper (46) relatively formed by recessed parts on the lower part of the second connecting member (30) at both ends thereof.

6. The lamp supporting device for an advertising sign according to claim 1, wherein each lamp supporter (60) has a groove (62) for receiving electric wire (3) formed on a rear side thereof so as to prevent the electric wire from being exposed and a lead-in hole (65) communicating with the groove (62) for receiving electric wire, that is formed on both sides at the lower part thereof, and wherein a plurality of the lamp supporters (60) can be fixed to the slide frame (50) in a way that each lamp supporter (60) is possible to be moved widthwise along the slide frame (50) so as to freely adjust the width between lamp supporters, thereby being able to arrange a number of lines of lamps (4) on one lamp supporting device (1).

7. The lamp supporting device for an advertising sign according to claim 1, wherein, when being continuously disposed, lamps (4) supported by each lamp supporter (60) can be arranged in a way being partially overlapped in a certain range without being interfered by the lamp supporters (60), thereby being possible to avoid blackening.

* * * * *